US009784230B2

(12) United States Patent
Pawlak et al.

(10) Patent No.: US 9,784,230 B2
(45) Date of Patent: Oct. 10, 2017

(54) IGNITION SYSTEM FOR AN INTERNAL COMBUSTION ENGINE

(71) Applicant: Robert Bosch GmbH, Stuttgart (DE)

(72) Inventors: Thomas Pawlak, Immenstadt (DE); Tim Skowronek, Missen-Wilhams (DE)

(73) Assignee: Robert Bosch GmbH, Stuttgart (DE)

( * ) Notice: Subject to any disclaimer, the term of this patent is extended or adjusted under 35 U.S.C. 154(b) by 13 days.

(21) Appl. No.: 14/426,595

(22) PCT Filed: Sep. 12, 2013

(86) PCT No.: PCT/EP2013/068872
§ 371 (c)(1),
(2) Date: Mar. 6, 2015

(87) PCT Pub. No.: WO2014/041050
PCT Pub. Date: Mar. 20, 2014

(65) Prior Publication Data

US 2015/0219062 A1 Aug. 6, 2015

(30) Foreign Application Priority Data

Sep. 12, 2012 (DE) ..... 10 2012 216 182
Sep. 11, 2013 (DE) ..... 10 2013 218 213

(51) Int. Cl.
*F02P 3/08* (2006.01)
*F02P 9/00* (2006.01)
(Continued)

(52) U.S. Cl.
CPC ..... *F02P 3/08* (2013.01); *F02P 3/0442* (2013.01); *F02P 3/0853* (2013.01); *F02P 9/002* (2013.01);
(Continued)

(58) Field of Classification Search
CPC ..... F02P 3/053; F02P 15/12; F02P 15/008; F02P 15/10; F02P 9/002; F02P 9/007;
(Continued)

(56) References Cited

U.S. PATENT DOCUMENTS 3,760,782 A * 9/1973 Meyer ..... F02P 3/005 123/604
4,051,822 A * 10/1977 Yoshida ..... F02P 3/0456 123/406.6
(Continued)

FOREIGN PATENT DOCUMENTS

CA 229 6615 7/2001
CN 2527734 Y 12/2002
(Continued)

OTHER PUBLICATIONS

International Search Report for PCT/EP2013/068872, dated Feb. 13, 2013.

*Primary Examiner* — Mahmoud Gimie
(74) *Attorney, Agent, or Firm* — Norton Rose Fulbright US LLP; Gerard Messina

(57) ABSTRACT

An ignition system includes: a step-up transformer having a primary side and a secondary side; an electric energy source which is able to be connected to the primary side; a spark gap, which is designed to carry a current transferred to the secondary side by the step-up transformer. The step-up transformer has a bypass for transferring electric energy from the electric energy source to the secondary side. The bypass is designed to support a decaying electrical signal in the secondary coil of the high-voltage generator as of a predefined time, or as of a predefined intensity of the current being reached.

11 Claims, 6 Drawing Sheets

(51) Int. Cl.
*F02P 15/10* (2006.01)
*F02P 3/04* (2006.01)
*F02P 17/12* (2006.01)

(52) U.S. Cl.
CPC ..... *F02P 15/10* (2013.01); *F02P 9/007* (2013.01); *F02P 2017/121* (2013.01)

(58) Field of Classification Search
CPC ..... F02P 3/10; F02P 3/0834; F02P 3/0876; F02P 3/04; F02P 3/045; F02P 3/05; F02P 17/02; F02P 17/12; F02P 2017/121; F02P 3/0407; F02P 5/1502; F02P 5/15; F02P 3/08; F02P 3/0442; F02P 3/0853; F02D 41/221; F02D 2041/2013; F02D 2041/2006
USPC ..... 123/640, 641, 620, 621, 622, 644, 655, 123/650, 651, 596, 609, 611, 618, 628, 123/636, 595
See application file for complete search history.

(56) References Cited

U.S. PATENT DOCUMENTS 4,393,850 A * 7/1983 Nishida ..... F02P 9/007 123/536
4,495,446 A * 1/1985 Brown ..... H05B 41/046 315/127
5,097,815 A * 3/1992 Oota ..... F02P 15/008 123/606
5,197,448 A * 3/1993 Porreca ..... F02P 3/005 123/620
5,636,620 A * 6/1997 Kiess ..... F02P 17/12 123/625
5,654,868 A * 8/1997 Buer ..... F23Q 3/004 123/640
6,647,974 B1 * 11/2003 Cowan ..... F02P 3/10 123/604
6,729,317 B2 5/2004 Kraus
6,820,602 B1 * 11/2004 Masters ..... F02P 3/0456 123/406.58
7,021,299 B2 * 4/2006 Torrisi ..... F02P 7/035 123/618
8,485,166 B2 * 7/2013 Aida ..... F02P 3/09 123/597
8,555,867 B2 * 10/2013 Srinivasan ..... F02P 3/005 123/605
9,263,720 B2 2/2016 Timmons
2002/0121272 A1 * 9/2002 Kraus ..... F02P 3/051 123/644
2003/0089355 A1 * 5/2003 Vogel ..... F02P 15/10 123/620
2004/0000878 A1 * 1/2004 Petruska ..... F02P 17/12 315/209 CD
2004/0050377 A1 * 3/2004 Cowan ..... F02P 3/10 123/604
2005/0000502 A1 * 1/2005 Waters ..... F02P 3/051 123/620
2005/0279337 A1 * 12/2005 Biljenga ..... F02P 9/007 123/620
2006/0000460 A1 * 1/2006 Masters ..... F02P 3/0456 123/609
2008/0006253 A1 * 1/2008 Batchvarov ..... F02P 3/01 123/606
2008/0127937 A1 * 6/2008 Toriyama ..... F02P 3/053 123/406.12
2010/0206277 A1 * 8/2010 Kajita ..... F02P 9/007 123/620
2010/0319644 A1 * 12/2010 Choquette ..... F02P 3/005 123/169 R
2012/0017881 A1 * 1/2012 Kataoka ..... F02P 3/051 123/621
2012/0160222 A1 * 6/2012 Grady ..... F02P 3/04 123/622
2012/0186569 A1 * 7/2012 Shimakawa ..... F02P 15/10 123/644
2013/0241429 A1 * 9/2013 Ruan ..... F02P 3/053 315/220
2014/0057154 A1 * 2/2014 Timmons ..... H01M 2/1633 429/143
2014/0109886 A1 4/2014 Singleton et al.
2015/0034059 A1 * 2/2015 Heise ..... F02P 3/0442 123/622
2015/0219062 A1 * 8/2015 Pawlak ..... F02P 3/0853 123/596
2015/0219063 A1 * 8/2015 Pawlak ..... F02P 3/01 123/620
2016/0084215 A1 * 3/2016 Kondou ..... F02P 3/0435 123/620
2016/0138552 A1 * 5/2016 Itoi ..... F02P 9/002 315/127
2016/0245255 A1 * 8/2016 Sekine ..... F02N 11/0862
2016/0281673 A1 * 9/2016 Skowronek ..... F02P 17/12
2016/0298591 A1 * 10/2016 Skowronek ..... F02P 3/04
2016/0298593 A1 * 10/2016 Lorenz ..... F02D 41/009
2016/0312757 A1 * 10/2016 Skowronek ..... F02P 17/12

FOREIGN PATENT DOCUMENTS

CN 1533475 A 9/2004
CN 1675464 A 9/2005
DE 198 38 003 3/2000
DE 10 226 607 12/2002
DE 10 2005 012 282 9/2006
DE 10 2005 034 294 1/2007
DE 10 2006 040982 3/2008
DE 102006040982 A1 * 3/2008 ..... F02P 3/0435
EP 0 181 961 5/1986
EP 1 199 470 4/2002
EP 2 325 476 5/2011
GB 717676 11/1954
JP S60 169675 9/1985
JP S60-204965 A 10/1985
JP H01-142269 A 6/1989
JP H05-164028 A 6/1993
JP H06-213119 A 8/1994
JP H07-174063 A 7/1995
JP H08-338298 A 12/1996
JP H09-144641 A 6/1997
JP 3106434 B2 11/2000
JP 2015-529774 A 10/2015
JP 2015-531153 A 10/2015
WO WO 93/04279 3/1993
WO WO 2009 106 100 9/2009
WO WO 2014/041050 3/2014

* cited by examiner

IGNITION SYSTEM FOR AN INTERNAL COMBUSTION ENGINE

BACKGROUND OF THE INVENTION

1. Field of the Invention

The present invention relates to an ignition system for an internal combustion engine, on which there exist increased requirements by (high pressure) supercharging and diluted mixtures, that are difficult to ignite ($\lambda >> 1$, lean layer concept, high EGR rates).

2. Description of the Related Art

British patent document GB717676 shows a step-up transformer for an ignition system in which a circuit element, controlled by a vibration switch, of the type of a boost converter is used to supply a spark, generated via the step-up transformer, with electric power.

International patent application document WO 2009/106100 A1 shows a circuit configuration designed corresponding to a capacitor-discharge ignition system, in which energy stored in a capacitor is conducted, on the one side, onto the primary side of a transformer and, on the other side, via a bypass having a diode, to a spark gap.

US patent application publication document 2004/000878 A1 shows an ignition system in which an energy store on the secondary side, including several capacitors, is charged in order to supply a spark generated by a transformer with electric energy.

International patent application document WO9304279 A1 shows an ignition system having two energy sources. One energy source transforms electric energy via a transformer to a spark gap, while the second energy source is situated between a terminal on the secondary side of the transformer and the electrical ground.

As is known, ignition systems for internal combustion engines are based on a high-voltage generator such as a step-up transformer, using which, energy originating from the vehicle battery or a generator is transformed to high voltages, by which a spark gap is supplied, in order to ignite combustible mixture in the internal combustion engine. For this purpose, a current flowing through the step-up transformer is abruptly interrupted, whereupon the energy stored in the magnetic field of the step-up transformer discharges in the form of a spark.

In order to ensure the ignition of the combustion mixture particularly reliably, ignition systems are known in the related art which have a plurality of sparking events successively in time in order to increase the probability of the presence of an ignitable mixture at the location of one of the sparking events.

A further problem known from the related art is that the entire electric energy converted during the arcing has to be stored in the high-voltage generator, whereby the high-voltage generator becomes comparatively large and costly with that, and requires much installation space.

Based on the discharge characteristics of the high-voltage generator, such a high current flows at the beginning of the arcing that the electrodes of the spark gap are eroded. Therefore, such a high current is physically not required to guarantee a spark. Only the required duration of the arcing is ensured in this way, while one has to accept the disadvantages described above.

It is therefore one object of the present invention to remove the abovementioned disadvantages of the related art.

BRIEF SUMMARY OF THE INVENTION

According to the present invention, the abovementioned object is attained by an ignition system and a method for generating and maintaining an ignition spark. As is known from the related art, the ignition system according to the present invention also has a high-voltage generator such as a step-up transformer, having a primary side which is connected to an energy source, and a secondary side which is connected to a spark gap. The basic method of functioning of the high-voltage generator also corresponds to the one known from the related art, and therefore does not have to be explained further. Furthermore, a spark gap is also provided from the related art, which is designed to carry a current transferred to the secondary side by the high-voltage generator. The spark gap, in this context, may be situated in a spark plug, for example. Since smaller voltages are required for maintaining an existing electric arc, over the spark gap, than are required for initially generating the same, a bypass is provided according to the present invention, which is able to transfer electric energy from the electric energy source to the secondary side, going past the high-voltage generator. In this case, a plurality of possible circuits is conceivable as a bypass, of which individual ones will be discussed in greater detail below. In order to remove the disadvantages known in the related art, the bypass is designed to maintain an electric arc generated by the high-voltage generator longer and more reliably over the spark gap than would be possible using the magnetic energy stored in the high-voltage generator. According to the present invention, the bypass is designed to support a decaying electrical signal in the secondary coil of the high-voltage generator as of a predefined time, or as of a predefined intensity of the current being reached. In other words, a logic system may be provided in the ignition system according to the present invention, which carries out a time measurement and/or ascertains a current intensity and, in responding to the reaching of corresponding predefined reference values, causes the bypass to emit a secondary side electrical signal. In this way, spark durations may be generated preferably between 0.5 ms to 5 ms at spark currents preferably within the limits of 30 mA to 100 mA of different polarities (polarity of the voltage systems). This has the advantage that the energy to be transmitted via the high-voltage generator is greatly reduced and thus the initial spark current drops, whereupon spark erosion on the electrodes of the spark gap is able to be reduced, and the high-voltage generator may be designed clearly smaller than is the case in the related art.

The high-voltage generator is preferably designed as a step-up transformer and has a primary coil on the primary side and a secondary coil on the secondary side. The two coils may be coupled to each other magnetically using a transformer core (made of iron sheet, for example). In this context, the bypass is designed to transmit an electric voltage to the step-up transformer in addition, which is added to a transformed voltage lying over the secondary coil of the step-up transformer. In this way, the bypass enables a "supporting" of the spark current by an input of additional electric energy to the spark gap.

Alternatively, the high-voltage generator may be developed as a capacitor-discharge ignition (CDI) system. Such systems and others for high-voltage generation, as well as their methods of functioning, are known and described in the related art, so that more detailed discussion is not necessary at this point.

Further preferred, the bypass may include an energy store or (advantageously for the combined handling of occasionally occurring high voltages) a plurality of energy stores, preferably one capacitor or several, connected in series and/or in parallel, whose first terminal is connected to a secondary side terminal of the high-voltage generator and whose second terminal is connected to electric ground, in particular, a switchable inductor being provided between the energy source and the capacitor. In this way, the bypass provides a secondary side energy store, using which, the decaying electrical signal in the secondary coil of the high-voltage generator is able to be supported as of a predefined time or as of a predefined current intensity being reached. As will be explained in greater detail in connection with the attached drawing figures, a switchable inductor may be provided between the energy source and the capacitor for charging the capacitor. When the switch is closed, the capacitor and the inductor form an oscillating circuit by which an intermittent raising of the electric potential is possible at the first terminal of the capacitor. In particular, in the case where first a current is conducted through the inductor, and because of a switching process, a discharge is forced of the energy stored in the inductor onto the capacitor, at suitably selected switching times, very high voltages may be provided without one's having to store the required energy temporarily within a high-voltage generator.

Further preferred, between the conductor and the capacitor, a nonlinear two-terminal element, such as in the form of a diode, may be provided which has forward direction in the direction of the capacitor. In this way it may be prevented that, when the switch is closed, energy "escapes" from the capacitor in the direction of the inductor. Within the scope of the present invention, when we are talking about a "diode" as a nonlinear two-terminal element, this is for reasons of brevity and readability. It is clear to one skilled in the art that occasionally voltages may be present over the nonlinear two-terminal element designated as a diode, which could possibly be handled better and more reliably by more components in combination, such as diodes connected in series. In this context, each of the diodes may be developed as a Zener diode. If necessary, a contained switch may advantageously also be closed in response to a signal when a predefined first current direction is to be expected in the nonlinear branch, and is opened when a predefined second direction of current (in an opposite direction) is to be expected in the nonlinear branch. In the following text, if several diodes may advantageously be used and have high voltages applied to them, what was said previously should also apply correspondingly to them. In particular, a switchable connection between a common terminal between the inductor and the diode on the one side and the electric ground may be provided on the other side. In this way, it is possible, when the switch is closed, to provoke a current flow through the inductor and to divert the current over the diode to the capacitor by opening the switch. At suitable selection of the pulse-no-pulse ratio and/or of the control frequency, a high voltage may be produced in this instance at very good efficiency.

In a further preferred manner, current measuring means, for instance, between an output terminal of the high-voltage generator and the capacitor may be provided which may be developed as a shunt resistor, for example. These current measuring means may further be situated, for instance, between the capacitor and ground, and be designed, in this context, to emit a signal to a switch in the bypass, so that it is able to react to a critical current intensity in the secondary loop. Alternatively or in addition, an overvoltage protection may be provided, such as a diode in parallel to the capacitor, which safeguards the capacitor from an overvoltage. A Zener diode may be used, for instance, in the blocking direction, in order to create unloading at high voltage over the capacitor.

Alternatively or in addition, a voltage measurement and/or a power measurement may be carried out, for instance, over the capacitor, to obtain an insight into the ignition current and/or the ignition power.

In a further preferred manner, the inductor may also be developed as a transmitter or transformer having a primary side and a secondary side, a first terminal of the primary side being connected to the energy source and a second terminal of the primary side being connected to the electric ground via a switch. Furthermore, a first terminal of the secondary side of the transformer is connected to the energy source and a second terminal of the secondary side of the transformer is connected to the diode, as described before. At a suitable selection of the transmission ratio, a switch provided on the primary side may be provided in this way to switch a current flowing on the secondary side. Because of the transformation ratio, favorable conditions arise for dimensioning the switch, and, in this way, a reliable and cost-effective implementation of the ignition system according to the present invention.

According to a further aspect of the present invention, a method is provided for generating an ignition spark for an internal combustion engine. In this context, an ignition spark is first produced using electric energy taken from an energy source, which is passed to a spark gap via a high-voltage generator having a primary side and a secondary side. According to the present invention, the ignition spark is maintained, using electric energy, which is transferred from the energy source via a bypass to the secondary side. For the purpose of maintaining the ignition spark, the electric energy is provided from the energy source as a controlled pulse sequence, in the kiloHertz range, for example, preferably between 10 kHz and 100 kHz In the abovementioned keying in the kHz range, it is possible to generate voltages in the range up to several 1000 V at an improved efficiency, which may be used for supporting the ignition spark if the energy stored in the high-voltage generator is no longer sufficient to maintain the electric arc reliably. Going beyond the advantages named, the use of the present invention has advantages with respect to the efficiency of the electric ignition system as well as opportunities for novel diagnostic functions. Both for the basic method according to this aspect of the present invention and for the refinements described below, it is true that the statements made in connection with the ignition system according to the present invention apply accordingly.

Further preferred, the electric energy for maintaining the ignition spark is coupled in as electric voltage in series or in parallel to the secondary side of the high-voltage generator. In other words, a coupling section of the bypass in connection with the coil on the secondary side of the high-voltage generator forms a loop, whose voltage lies in parallel to the spark gap.

Exemplary embodiments of the present invention are described in detail below with reference to the accompanying drawings.

DETAILED DESCRIPTION OF THE INVENTION

Figure 1:
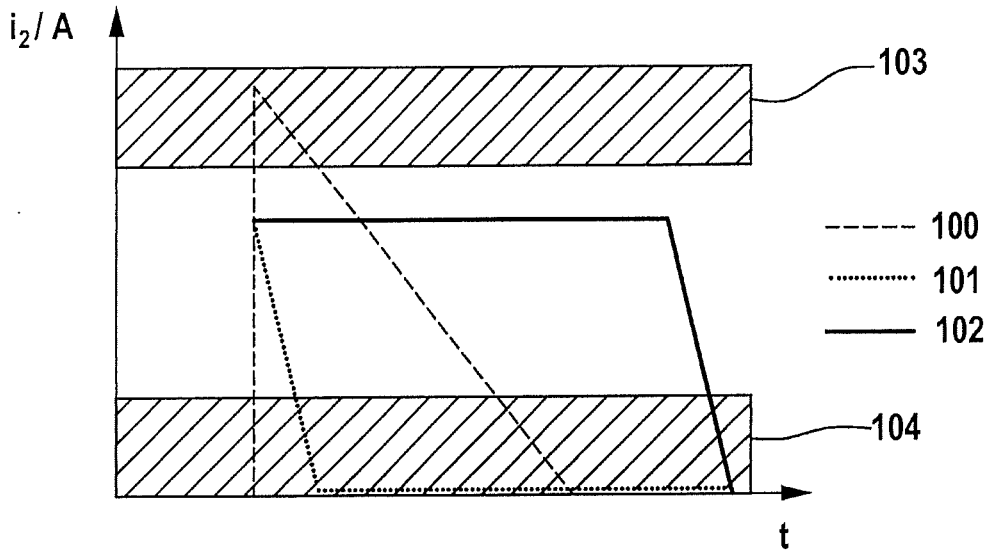
FIG. 1 shows a diagram over time comparing ignition currents setting in according to the related art and the present invention.

FIG. 1 shows a diagram over time of the ignition current, that is, of that current which, upon the sparkover of the spark gap, flows within the coil on the secondary side of the step-up transformer as the high-voltage generator. In this context, an area 103 is marked, within which the current is so high that the electrodes of the spark plug are able to be damaged by increased erosion. Area 104 marks those (low) current intensities within which a required stability of the electric arc for igniting ignitable mixture cannot be assured. As was described at the outset, thus a current 100, implemented by an ignition system of the related art, after a steep rise, runs into area 103, that endangers the electrodes, and thereafter drops off essentially linearly (in approximation to an exponential discharge function). By contrast, the energy conducted, according to the present invention, to the spark gap, divides into two energy portions, which are provided by a current, flowing through the step-up transformer, for generating an ignition spark and a current, flowing through the bypass, for maintaining an ignition spark. After the step-up transformer (that is dimensioned smaller compared to the related art) has generated an electric arc without the bypass, according to the present invention, the current would become steeply reduced (corresponding to the discharge of the small secondary inductor—with reference to conventional secondary inductors) (cf. illustration in FIG. 1, 101) and would already "vanish" briefly after its creation in area 104. Using the bypass according to the present invention, the current intensity on the secondary side or, to put it more accurately, in the spark gap, is able to be held (cf. illustration in FIG. 1, 102) over a substantially longer time period between the critical areas 103 and 104. After the bypass is switched off, the energy stored in the secondary coil discharges, same as in the related art, which leads to a spark current that is steeply dropping off. The result is an overall current which, however, dips into the unstable area 104 clearly later than current intensity 100 of the known ignition system.

Figure 2:
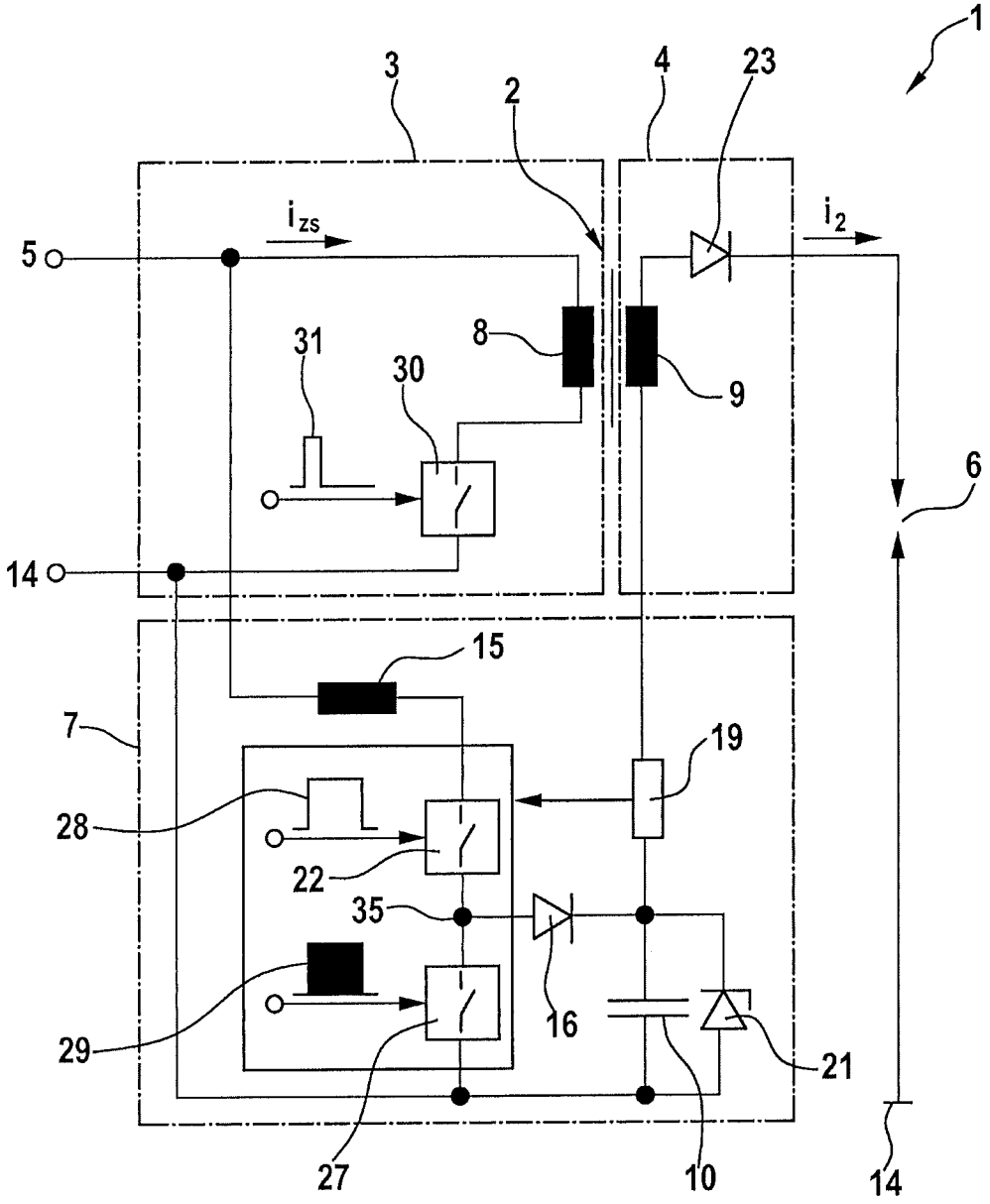
FIG. 2 shows a circuit diagram according to a first exemplary embodiment of an ignition system according to the present invention.

FIG. 2 shows a circuit using which current flows 101, 102, shown in FIG. 1, are implemented. What is shown is an ignition system 1 which includes a step-up transformer 2 as the high-voltage generator, whose primary side 3 is able to be supplied with electric energy from an electric energy source 5 via a first switch 30. Secondary side 4 of step-up transformer 2 is supplied with electric energy via an inductive coupling of primary coil 8 and secondary coil 9 and has a diode 23, known from the related art, for closing spark suppression, this diode being able also alternatively to be replaced by diode 21. In a loop with secondary coil 9 and diode 23, a spark gap 6 relative to frame 14 is provided, via which ignition current $i_2$ is supposed to ignite the combustible gas mixture. According to the present invention, a bypass 7 (bordered by a dash-dotted line) is provided between electric energy source 5 and secondary side 4 of step-up transformer 2. For this purpose, an inductor 15 is connected via a switch 22 and a diode 16 to a capacitor 10, whose one end is connected to secondary coil 9 and whose other end is connected to electric ground 14. In this instance, the inductor is used as an energy store, in order to maintain a current flow. Diode 16 is oriented conductive in the direction of capacitor 10. Consequently, the design of bypass 7 is comparable to a boost converter, for example. Between capacitor 10 and secondary coil 9 a shunt 19 is provided as a current measuring device or a voltage measuring device, whose measuring signal is supplied to switch 22 and switch 27. In this way, switches 22, 27 are designed to react to a specified range of current intensity $i_2$ through secondary coil 9. The terminal of switch 22 facing diode 16 is able to be connected via a further switch 27 to electric ground 14. To protect capacitor 10, a Zener diode 21 is connected in inoperative direction parallel to capacitor 10. Furthermore, switching signals 28, 29 are indicated, by the use of which switches 22, 27 are able to be controlled. While switching signal 28 represents a switching in and a "remaining closed" for an entire ignition cycle, switching signal 29 sketches a contemporaneous alternating signal between "closed" and "open". During a closed switch 22, inductor 15 is supplied with a current via electric energy source 5, which, during closed switches 22, 27, flows directly into electric ground 14. During an open switch 27, the current is conducted via diode 16 and terminal 35 to capacitor 10. The voltage setting in in capacitor 10 in response to the current is added to the voltage dropping off over secondary coil 9 of step-up transformer 2, whereby the electric arc at spark gap 6 is supported. In this context, however, capacitor 10 discharges, so that by closing switch 27, energy is able to be brought into the magnetic field of inductor 15, in order to charge this energy again onto capacitor 10, in response to a renewed opening of switch 27. In a recognizable way, the control of switch 30 that is provided on primary side 3 is clearly held to be shorter than is the case for switches 22 and 27. These processes will be discussed in greater detail in connection with FIG. 3. Since switch 22 for the processes according to the present invention does not assume any decisive function, but only switches the circuit on and off, it is only optional, and may therefore also be omitted.

Figure 3:
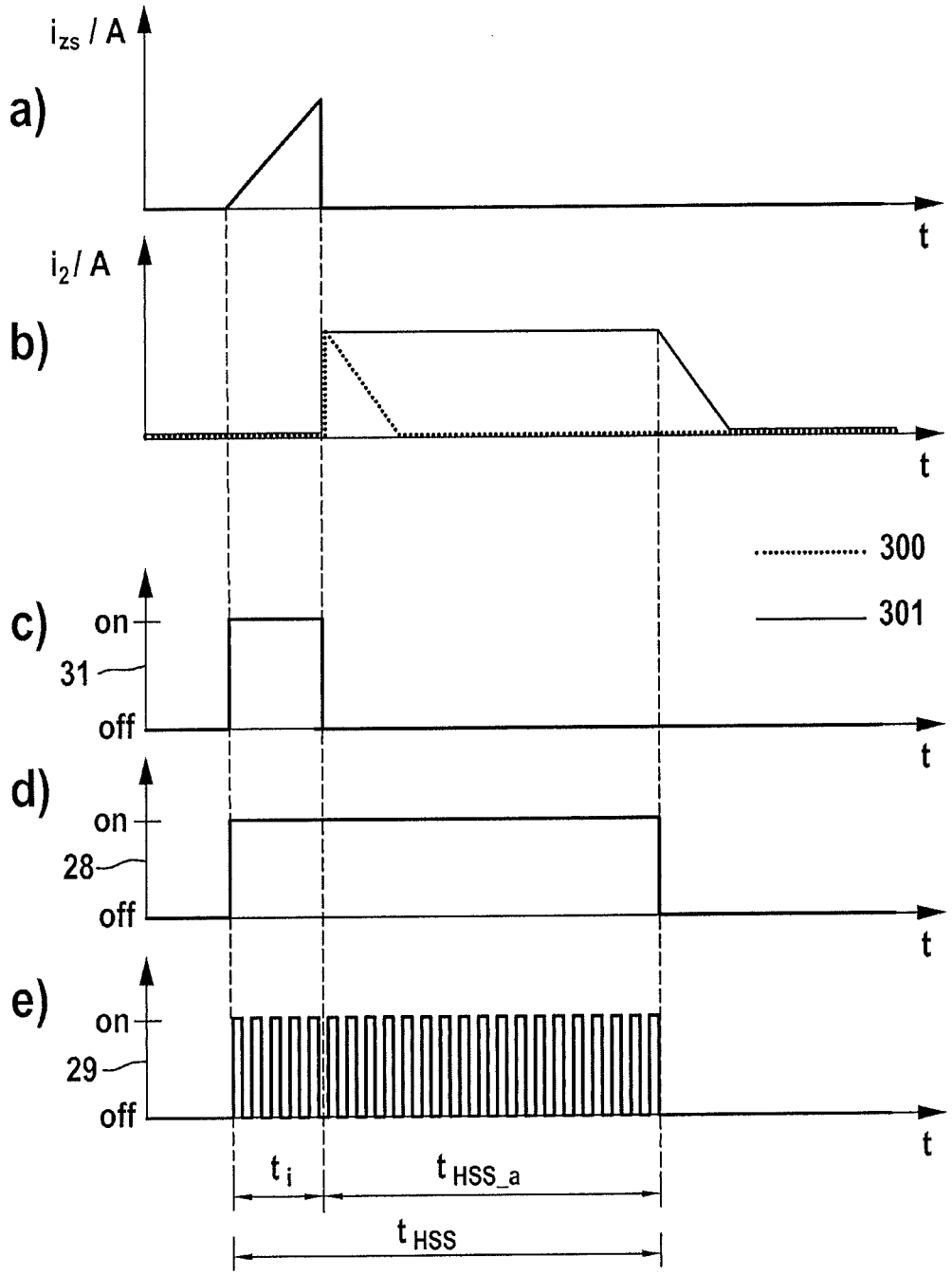
FIG. 3 shows representations of current-time diagrams as well as associated switching sequences for the circuit shown in FIG. 2.

FIG. 3, in Diagram a), shows a short and steep rise in primary coil current $i_{zs}$, which sets in at that particular time at which switch 30 (see Diagram 3*c*) is in conductive state ("ON"). When switch 30 is switched off, primary coil current $i_{zs}$ also drops off to 0 A. Diagram b) shows the curves of secondary coil current $i_2$, as they come about for a use of System 1 shown in FIG. 2 with (301) and without (300) the bypass. As soon as primary coil current $i_{zs}$ comes down to 0 based on the opening of switch 30, and as a result the magnetic energy stored in the step-up transformer discharges in the form of an electric arc over spark gap 6, a secondary coil current $i_2$ sets in which, without bypass (300) drops off rapidly towards 0. In contrast to this, because of a closed switch 22 (see Diagram d)) and a pulse-shaped control (see Diagram e)), switching signal 29) of switch 27 an essentially constant secondary coil current $i_2$ (301) is driven over spark gap 6. Secondary current $i_2$ depending on the sparking voltage at spark gap 6, and at this point a constant sparking voltage is assumed, for the sake of simplicity. Only after the interruption of bypass 7 by the opening of switch 22 and the opening of switch 27 does secondary coil current $i_2$ now also drop off towards 0. From Diagram b) it is recognizable that the side falling off in each case is delayed by a time duration $t_{HSS_a}$. The entire time duration during which the bypass is used is characterized as $t_{HSS}$ and the time during which energy is input on the primary side into step-up transformer 2 is characterized by $t_i$. The starting time of $t_{HSS}$ as compared to $t_i$ may be variably selected.

Figure 4:
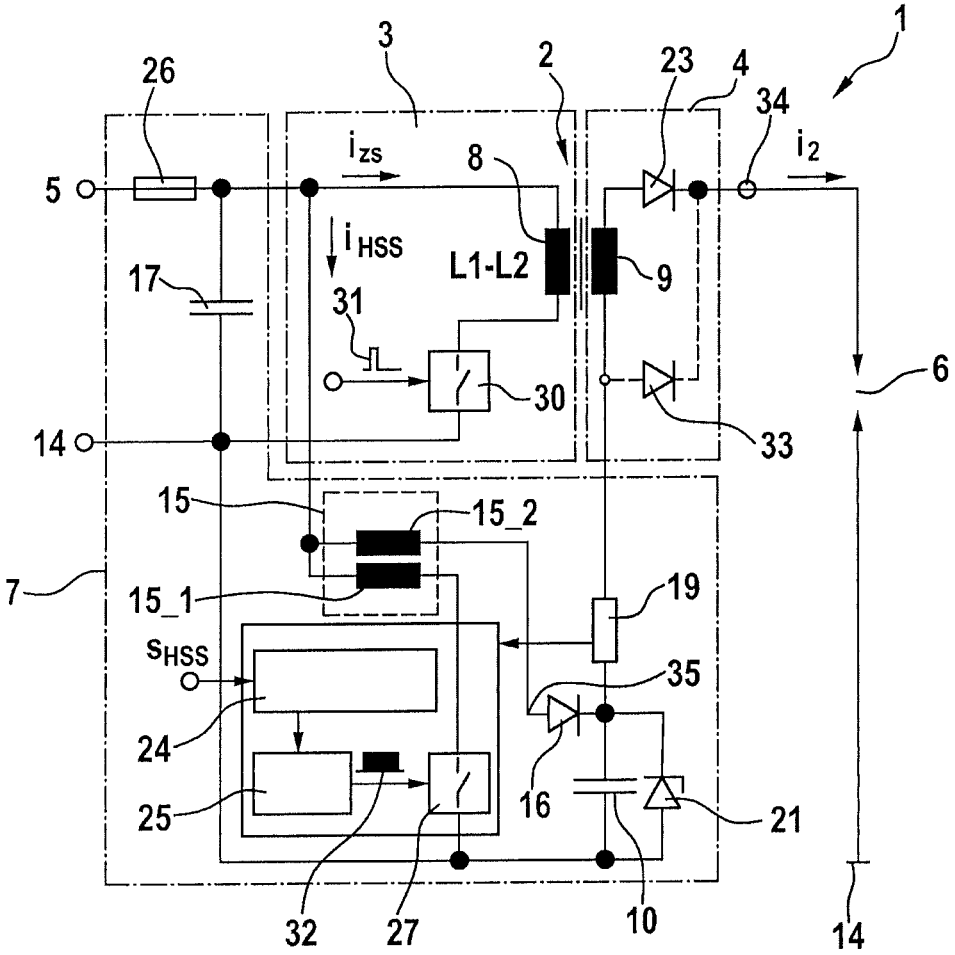
FIG. 4 shows a circuit diagram according to a second exemplary embodiment of an ignition system according to the present invention.

FIG. 4, as opposed to FIG. 2, shows an alternative specific embodiment of a circuit of an ignition system 1 according to the present invention. At the input to the circuit, thus in other words, at the terminal to electric energy source 5, a fuse 26 is provided. In addition, for the stabilization of the input voltage, a capacitor 17 is provided in parallel to the input of the circuit or rather, in parallel to electric energy source 5. Furthermore, inductor 15 has been replaced by a transformer having a primary side 15_1 and a secondary side 15_2, primary side 15_1 having a primary coil and secondary side 15_2 having a secondary coil. The first terminals of the transformer are each connected to electric energy source 5 or rather, fuse 26. In this context, a second terminal of primary side 15_1 is connected via switch 27 to electric ground 14. The second terminal of secondary side 15_2 of transformer 15 is now connected without a switch, directly to diode 16. Based on the transmission ratio, a switching process by switch 27 in the branch of primary side 15_1 acts also on secondary side 15_2. Since, however, current and voltage according to the transformation ratio are higher or lower on the one side than on the other side of transformer 15, more favorable dimensioning for switch 27 may be found for switching processes. For example, smaller switching voltages may be implemented, whereby the possibilities of dimensioning switch 27 are simpler and more cost-effective. Switch 27 is controlled via a control 24, which is connected to switch 27 via a driver 25. As shown in FIG. 2, a shunt 19 is provided in order to measure secondary current $i_2$ or the voltage over capacitor 10, and to provide this or these to control 24 of switch 27. Moreover, control 24 obtains a control signal $s_{HSS}$. Via this, on the one side, the input of energy via the bypass into the secondary side may be switched on and off. In this context, the power of the electrical variable inserted by the bypass or rather into the spark gap, may be controlled, particularly via the frequency and/or the pulse-no pulse ratio, via a suitable control signal. A nonlinear two-terminal element, symbolized below as a high-voltage diode 33, may optionally be connected in parallel to the secondary side coil of the boost converter. This high-voltage diode 33 bridges high-voltage generator 2 on the secondary side, whereby the energy supplied by bypass 7 in the form of a boost converter (bordered by a dash-dotted line) is carried directly to spark gap 6, without being carried by secondary coil 9 of high-voltage generator 2. Consequently, no losses are created via secondary coil 9 and the efficiency goes up. The remaining elements of the drawing shown in FIG. 4 correspond to those shown in FIG. 2 and which have already been discussed above.

Figure 5:
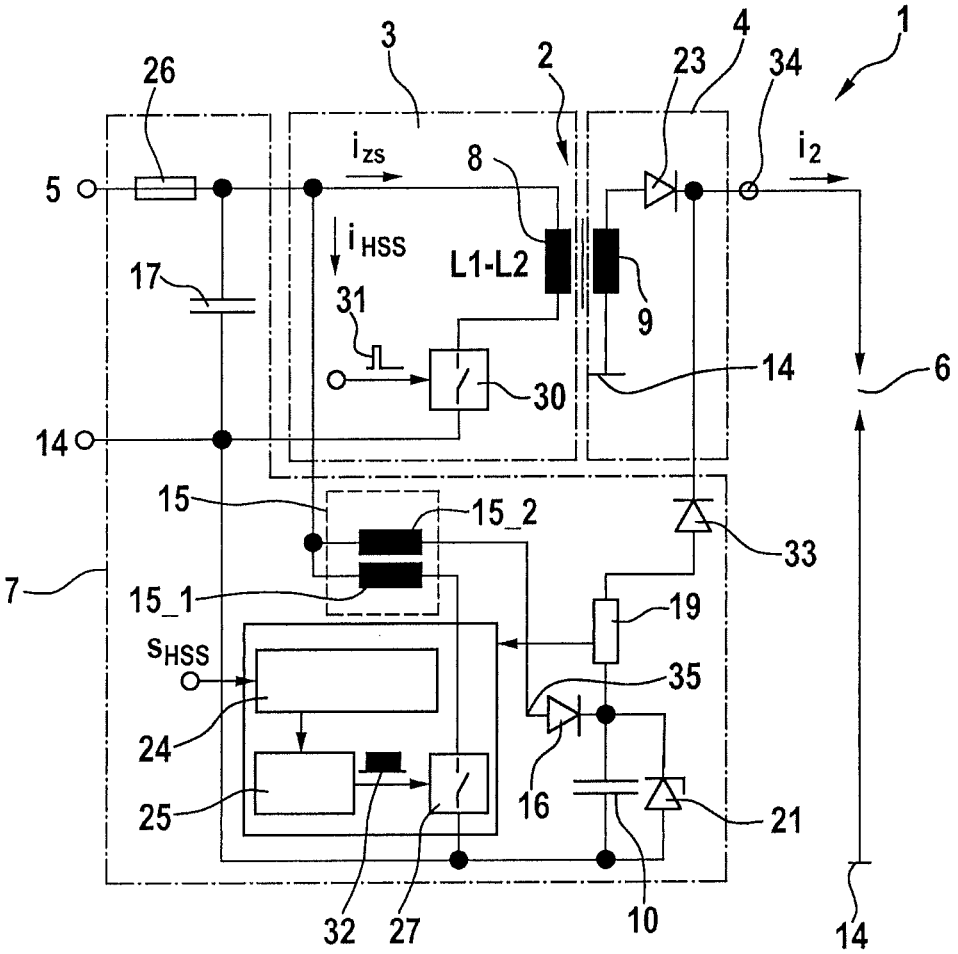
FIG. 5 shows a circuit diagram according to a third exemplary embodiment of an ignition system according to the present invention.

FIG. 5 shows an alternative specific embodiment of the circuit introduced in FIG. 4. In it, a high-voltage diode 33 having a direction of flow towards the spark gap between energy store 10 of bypass 7 in the form of a boost converter (bordered by a dash-dotted line) and spark gap 6. Hereby high-voltage diode 33 bridges high-voltage generator 2 on the secondary side, whereby the energy supplied by bypass 7 is carried directly to spark gap 6, without being carried by secondary coil 9 of high-voltage generator 2. Consequently, no losses are created via secondary coil 9 and the efficiency goes up.

Figure 6:
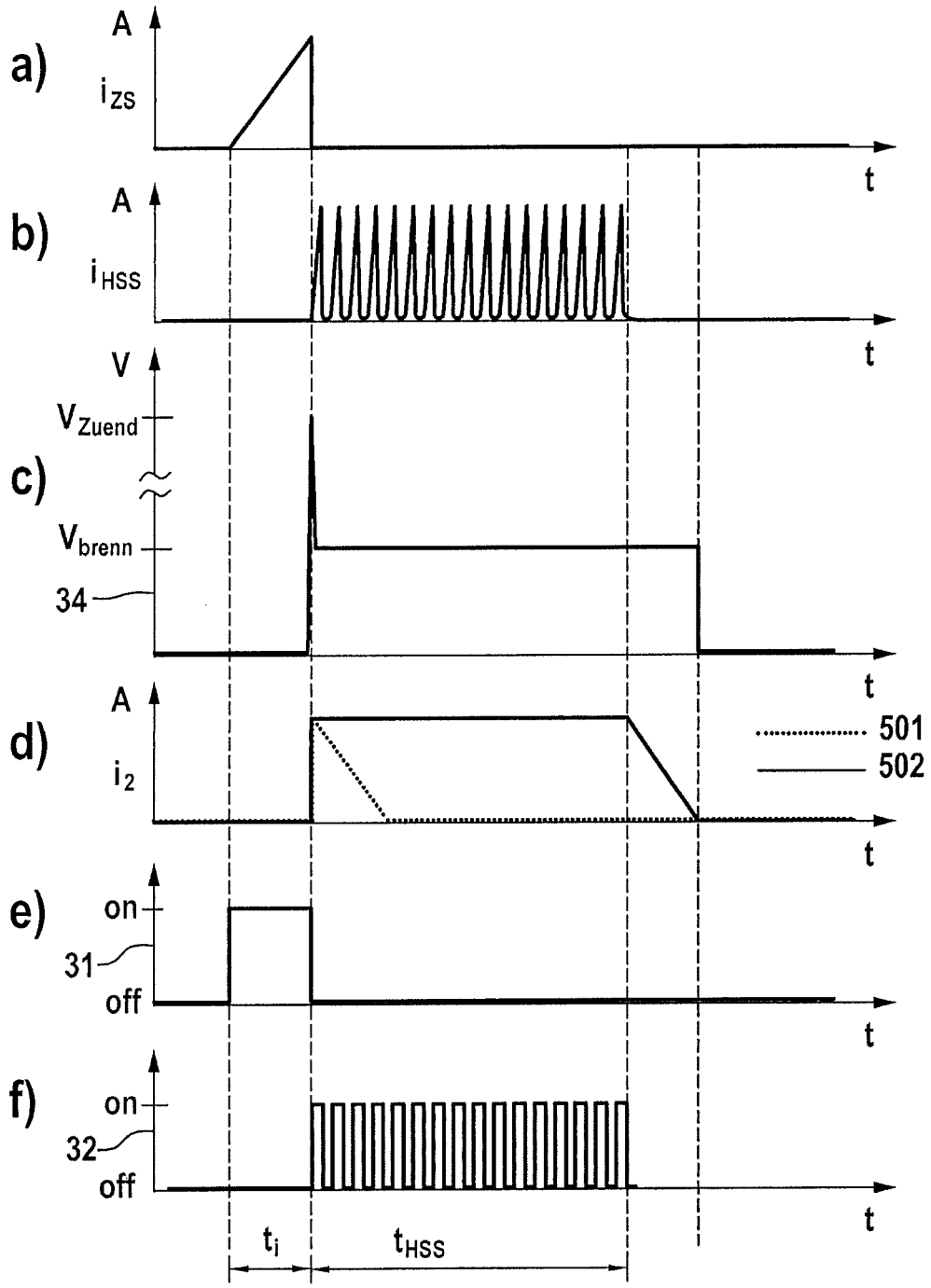
FIG. 6 shows representations of current-time diagrams as well as associated switching sequences for the circuit shown in FIG. 4 and FIG. 5.

FIG. 6 shows a diagram over time for a) ignition coil current $i_{zs}$, b) bypass current $i_{HSS}$, c) output side voltage over spark gap 6, d) secondary coil current i2 for the ignition system shown in FIG. 4 without (501) and with (502) the use of the bypass according to the present invention, e) switching signal 31 of switch 30 and f) switching signal 32 of switch 27 for the pulse signal in bypass 7. On the diagrams shown in connection with FIG. 3, we refer to the above discussion, for the sake of brevity.

Diagram b) illustrates, in addition, the current input of bypass 7 according to the present invention, which comes about by a pulse-shaped control of switch 27. In practice, pulse rates in the range of several times ten kHz have proven themselves as pulse rates, in order, on the one hand, to implement appropriate voltages and, on the other hand, acceptable efficiencies. For example, we may name whole-number multiples of 10000 Hz in the range between 10 and 100 kHz as possible range borders. In this context, for the regulation of the power output to the spark gap, one might recommend an, in particular, stepless regulation of the pulse-no pulse ratio of signal 29 and 32 for generating an appropriate output signal. In addition it is also possible, by using an additional DC-DC converter, to increase the voltage supplied by the electric energy source, before it is processed further in the bypass according to the present invention. It should be noted that specific designs depend on many circuit-inherent and external boundary conditions. It does not confront the concerned person skilled in the art with unreasonable problems for himself to undertake the suitable dimensioning, based on the boundary conditions he should observe for his own purposes.

The disclosure of the present invention is supplemented by the following subject matters:

1. An ignition system (1) including
   - at least one high-voltage generator (2) each having one primary side (3) and one secondary side (4), an electric energy source (5), that is able to be connected to the primary side (3), and
   - a spark gap (6), which is designed to carry a current transmitted by the high-voltage generator (2) to the secondary side (4), wherein
   - the high-voltage generator (2) has a bypass (7) for transferring electric energy to the secondary side (4).

2. The ignition system as recited in subject matter 1, wherein
   - the high-voltage generator (2) is designed as a step-up transformer and has a primary coil (8) on the primary side and a secondary coil (9) on the secondary side,
   - the bypass (7) is designed to generate a voltage which is added to a voltage lying over the secondary coil (9) or is fed in in parallel to the secondary coil, and in particular
   - an input capacitor (17) is provided in parallel to the energy source (5).

3. The ignition system as recited in one of the preceding subject matters, wherein the bypass (7) includes an energy store (10), such as a capacitor, whose
   - first terminal is connected to a secondary side terminal of the high-voltage generator (2), and its
   - second terminal is connected to electric ground (14), wherein particularly
   - an inductor (15) being provided between the energy source (5) and the energy store (10), preferably in a switchable manner.

4. An ignition system as recited in one of the preceding subject matters, wherein between the inductor (15) and the energy store (10) a first nonlinear two-terminal element (16) is provided, for instance, in the form of a first diode, which has a direction of flow in the direction of the capacitor (10), and in particular a switchable connection is provided between a common terminal between the inductor (15) and the first nonlinear two-terminal element (16) on the one side and the electric ground (14) on the other side.

5. The ignition system as recited in one of the preceding subject matters, wherein means for current measurement (19) and/or voltage measurement and/or power measurement, especially a shunt resistor for measuring the ignition current or the voltage over the energy store (10) are provided, which are designed to give a signal for controlling at least one switch (22, 27) in the bypass (7) and/or a second nonlinear two-terminal element (21), particularly in the form of a second diode, parallel to the energy store (10), protects same from an overvoltage.

6. The ignition system as recited in one of the preceding subject matters 3 through 5, the inductor (15) being developed as a transformer having a primary side (15_1) and a secondary side (15_2); a first terminal of the primary side (15_1) being connected to the energy source (5) and a second terminal of the primary side (15_1) being connected via a switch (27) to the electric ground (14); and a first terminal of the secondary side (15_2) being connected to the energy source (5) and a second terminal of the secondary side (15_2) being connected to the first nonlinear two-terminal element (16).

7. The ignition system as recited in one of the preceding subject matters, wherein the bypass (7) includes a boost converter and/or the high-voltage generator (2) is bridged on the secondary side by a third nonlinear two-terminal element (33), especially in the form of a third diode.

8. A method for generating an ignition spark for an internal combustion engine, including the steps:

generating an ignition spark using electric energy taken from an energy source (5), which is given via an high-voltage generator (2), particularly a step-up transformer, having a primary side (3) and a secondary side (4) to a spark gap (6), characterized by the maintaining of the ignition spark using electric energy which is transferred from the energy source (5) via a bypass (7) to the secondary side (4).

9. The method as recited in subject matter 8, wherein the electric energy for maintaining the ignition spark is coupled in as electric voltage in series or in parallel to the secondary side (4) of the high-voltage generator (2), and/or the electric energy for maintaining the ignition spark is provided from the energy source (5) via a controlled pulse sequence, particularly in the kiloHertz range, preferably between 10 kHz and 100 kHz.

10. The method as recited in subject matter 8 or 9, wherein the electric energy for maintaining the ignition spark reaches the spark gap (6) via a boost converter in the bypass (7).

It is a central idea of the present invention advantageously to split up, according to the present invention, two functions which have unified the step-up transformers of known ignition systems, in order to make possible suitable dimensioning of the high-voltage generator and efficient utilization of the electric energy. For this purpose, a high-voltage generator is provided in order to generate an ignition spark according to the related art. A bypass is designed to maintain the existing electric arc over the spark gap. To do this, a bypass takes energy from, for instance, the same energy source as the primary side of the high-voltage generator and uses it to support the decaying edge of the transformer voltage, and thus to delay its dropping off below the sparking voltage. One skilled in the art will recognize, in this instance, preferred specific embodiments of the bypass, according to the present invention, as switching structures working in the manner of a boost converter. In this context, the input of the boost converter is connected in parallel to the electric energy source, while the output of the boost converter is situated in series or in parallel to the secondary coil of the high-voltage generator. The concept of an "energy source" should be broadly interpreted within the scope of the present invention, and may include additional energy-converting devices, such as DC-DC converters. Moreover, it is obvious to one skilled in the art that the inventive idea is not limited to a representational energy source.

Even though the aspects according to the present invention and the advantageous specific embodiments have been described in detail with the aid of the exemplary embodiments explained in connection with the attached drawing figures, modifications and combinations of features of the exemplary embodiments are possible for one skilled in the art, without his having to leave the range of the present invention, whose range of protection is specified by the attached claims.

What is claimed is:

1. An ignition system, comprising:

at least one high-voltage generator having one primary side and one secondary side;

an electric energy source configured to be connected to the primary side; and a spark gap which is configured to carry a current transmitted by the high-voltage generator to the secondary side;

wherein the high-voltage generator has a bypass for transferring electric energy to the secondary side, and wherein the bypass is configured to delay a decay of a decaying electrical signal in a secondary coil of the secondary side of the high-voltage generator one of (i) as of a predefined time, or (ii) as of a predefined intensity of the current being reached, wherein the bypass includes at least one capacitor as an energy store having a first terminal connected to a secondary side terminal of the high-voltage generator and a second terminal connected to electric ground;

an inductor is provided in a switchable manner between the energy source and the energy store, wherein the inductor is a transformer having a primary side and a secondary side, a first terminal of the primary side of the inductor being connected to the energy source and a second terminal of the primary side of the inductor being connected via a switch to the electric ground, wherein a first terminal of the secondary side of the inductor is connected to the energy source and a second terminal of the secondary side of the inductor is connected via a first nonlinear two-terminal element to the at least one capacitor, at least one of a current measurement device, a voltage measurement device, and a power measurement device which is configured to measure the secondary side current or the voltage via the capacitor and provide the measured value to a control configured for controlling the switch, and wherein the power of the electrical variable inserted by the bypass into the spark gap is controlled via a control signal of the control running to the switch via at least one of a frequency or a pulse-no pulse ratio of the control signal.

2. The ignition system as recited in claim 1, wherein the at least one of a current measurement device, a voltage measurement device, and a power measurement device is configured to provide a signal to a switch in the bypass so that the switch is able to react to a critical current intensity in a loop on the secondary side.

3. The ignition system as recited in claim 2, wherein:

the high-voltage generator is configured as a step-up transformer and has a primary coil on the primary side;

the bypass is configured to generate a voltage which is one of (i) added to a voltage lying over the secondary coil or (ii) is fed in in parallel to the secondary coil; and an input capacitor is provided in parallel to the energy source.

4. The ignition system as recited in claim 1, wherein between the inductor and the energy store, the first nonlinear two-terminal element has a direction of flow in the direction of the capacitor, and a switchable connection is provided between a common terminal of the inductor and the first nonlinear two-terminal element on the one side and the electric ground on the other side.

5. The ignition system as recited in claim 4, wherein the switchable connection includes a switch in the form of a transistor.

6. The ignition system as recited in claim 2, wherein:

the bypass has an inductor, the capacitor, a diode and a switch;

a first terminal of the inductor is connected to the energy source and a second terminal of the inductor is connected to a first terminal of the diode;

the switch is configured to selectively connect one of the second terminal or a third terminal of the inductor to the electric ground;

a second terminal of the diode is connected to a first terminal of the capacitor; and a second terminal of the capacitor is connected to the electric ground, and a Zener diode of the capacitor is connected in parallel.

7. The ignition system as recited in claim 2, wherein at least one of:

(i) the least one of the current measurement device, the voltage measurement device, and the power measurement device is a shunt resistor configured to provide a signal for controlling at least one switch in the bypass; and (ii) a second nonlinear two-terminal element parallel to the energy store protects the energy store from an overvoltage.

8. The ignition coil as recited in claim 1, wherein at least one of (i) the bypass includes a boost converter, and (ii) the high-voltage generator is bridged on the secondary side by a third nonlinear two-terminal element.

9. A method for generating an ignition spark for an internal combustion engine, comprising:

generating an ignition spark using electric energy stored in an energy source, which electric energy is transferred via a step-up transformer to a spark gap, the step-up transformer having a primary side and a secondary side;

maintaining the ignition spark using electric energy which is transferred from the energy source via a bypass to the secondary side, wherein the electric energy for maintaining the ignition spark is provided from the energy source as a controlled pulse sequence between 10 kHz and 100 kHz; and controlling a switch in the bypass responsive to a current intensity in the secondary side.

10. The method as recited in claim 9, wherein the electric energy for maintaining the ignition spark is coupled in as electric voltage to the secondary side of the high-voltage generator.

11. The method as recited in claim 10, further comprising:

outputting a signal to the switch in the bypass; and based on the signal, providing a remedial measure in response to a critical current intensity in the loop on the secondary side.

* * * * *